US008476847B2

(12) United States Patent
Riesebosch

(10) Patent No.: US 8,476,847 B2
(45) Date of Patent: Jul. 2, 2013

(54) THERMAL FOLDBACK SYSTEM

(75) Inventor: Scott Riesebosch, St. Catherines (CA)

(73) Assignee: CRS Electronics, Ontario (CA)

( * ) Notice: Subject to any disclaimer, the term of this patent is extended or adjusted under 35 U.S.C. 154(b) by 278 days.

(21) Appl. No.: 13/092,445

(22) Filed: Apr. 22, 2011

(65) Prior Publication Data

US 2012/0268040 A1 Oct. 25, 2012

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.

USPC ..... 315/309; 315/291; 315/307; 315/308

(58) Field of Classification Search

None

See application file for complete search history.

(56) References Cited

U.S. PATENT DOCUMENTS

| | | | |
|---|---|---|---|
| 4,047,049 | A | 9/1977 | Erickson et al. |
| 5,297,013 | A | 3/1994 | Hall et al. |
| 5,977,692 | A | 11/1999 | Itaya et al. |
| 6,836,157 | B2 | 12/2004 | Rader et al. |
| 7,091,874 | B2 | 8/2006 | Smithson |
| 7,196,481 | B2 | 3/2007 | Bushell et al. |
| 7,206,015 | B2 | 4/2007 | Tang et al. |
| 7,269,191 | B2 | 9/2007 | Stewart et al. |
| 7,276,861 | B1 | 10/2007 | Shteynberg et al. |
| 7,286,123 | B2 | 10/2007 | Yang |
| 7,295,176 | B2 | 11/2007 | Yang |
| 7,414,370 | B2 | 8/2008 | Kunjappan |
| 7,492,108 | B2 | 2/2009 | Garcia et al. |
| 7,609,008 | B1 | 10/2009 | Kohler |
| 7,626,346 | B2 | 12/2009 | Scilla |
| 7,635,957 | B2 | 12/2009 | Tripathi et al. |
| 7,656,366 | B2 | 2/2010 | Ashdown |
| 7,663,326 | B2 | 2/2010 | Santo et al. |
| 7,675,250 | B2 | 3/2010 | Chitta et al. |
| 7,701,151 | B2 | 4/2010 | Petrucci et al. |
| 7,733,034 | B2 | 6/2010 | Kotikalapoodi et al. |
| 7,755,303 | B2 | 7/2010 | Johnson et al. |
| 7,768,212 | B2 | 8/2010 | Chen et al. |
| 7,777,424 | B2 | 8/2010 | Hebborn |
| 7,777,430 | B2 | 8/2010 | Catalano et al. |
| 7,786,676 | B2 | 8/2010 | Cheng et al. |
| 7,825,610 | B2 | 11/2010 | Zhao et al. |
| 2004/0032221 | A1 | 2/2004 | Bushell et al. |
| 2006/0186830 | A1 | 8/2006 | Shami et al. |
| 2007/0035538 | A1 | 2/2007 | Garcia et al. |
| 2007/0195527 | A1 | 8/2007 | Russell |
| 2007/0279900 | A1 | 12/2007 | Bauer et al. |
| 2007/0295912 | A1 | 12/2007 | Jurgen et al. |
| 2008/0018261 | A1 | 1/2008 | Kastner |
| 2008/0037239 | A1 | 2/2008 | Thomas et al. |
| 2008/0111505 | A1 | 5/2008 | Wang et al. |
| 2008/0224625 | A1 | 9/2008 | Greenfeld |

(Continued)

FOREIGN PATENT DOCUMENTS

| | | |
|---|---|---|
| KR | 100779971 | 11/2007 |
| KR | 20070074077 | 12/2007 |

(Continued)

*Primary Examiner* — Anh Tran

(74) *Attorney, Agent, or Firm* — Bingham McCutchen LLP

(57) ABSTRACT

A thermal-foldback system detects an over-temperature condition in an LED lamp. In response to the over-temperature condition, the thermal-foldback system chops a portion of the input power waveform drawn by the LED lamp.

19 Claims, 6 Drawing Sheets

U.S. PATENT DOCUMENTS

| | | | | |
|---|---|---|---|---|
| 2009/0033245 | A1 | 2/2009 | Tsai et al. | |
| 2009/0033248 | A1 | 2/2009 | Cottongim et al. | |
| 2009/0146585 | A1 | 6/2009 | Huang et al. | |
| 2009/0167202 | A1 | 7/2009 | Miskin et al. | |
| 2009/0256486 | A1 | 10/2009 | Lai | |
| 2009/0261748 | A1 | 10/2009 | McKinney et al. | |
| 2009/0273301 | A1 | 11/2009 | De Anna et al. | |
| 2009/0289559 | A1 | 11/2009 | Tanaka et al. | |
| 2009/0295292 | A1 | 12/2009 | Harmgardt et al. | |
| 2009/0302770 | A1 | 12/2009 | Weis et al. | |
| 2010/0013395 | A1 | 1/2010 | Archibald et al. | |
| 2010/0013409 | A1 | 1/2010 | Quek et al. | |
| 2010/0045210 | A1 | 2/2010 | Hariharan | |
| 2010/0084994 | A1 | 4/2010 | Kao | |
| 2010/0134049 | A1 | 6/2010 | Matsuoka et al. | |
| 2010/0156315 | A1 | 6/2010 | Zhao et al. | |
| 2010/0164404 | A1 | 7/2010 | Shao et al. | |
| 2010/0194308 | A1 | 8/2010 | Zhao et al. | |
| 2010/0231136 | A1 | 9/2010 | Reisenauer et al. | |
| 2010/0295617 | A1 | 11/2010 | Muentefering et al. | |
| 2011/0121760 | A1* | 5/2011 | Harrison et al. | 315/309 |
| 2011/0140620 | A1* | 6/2011 | Lin et al. | 315/224 |

FOREIGN PATENT DOCUMENTS

| | | |
|---|---|---|
| TW | 1282713 | 7/1994 |
| WO | WO9400965 | 1/1994 |
| WO | WO2007100207 | 9/2007 |
| WO | WO2009022153 | 2/2009 |
| WO | WO2010027254 | 3/2010 |
| WO | WO2010090832 | 8/2010 |

* cited by examiner

THERMAL FOLDBACK SYSTEM

TECHNICAL FIELD

Embodiments of the invention generally relate to thermal protection in lighting elements and, more particularly, to thermal foldback circuits that adjust a lighting-element power level.

BACKGROUND

A light-emitting-diode ("LED") lamp (also known as a bulb or, more generally, an LED lighting product) may be used to replace an incandescent, halogen, or other bulb; the LED lamp provides the same or similar light while consuming less power. The LED lamp includes at least one LED, support circuitry to drive the LED (such as a transformer, dimmer, LED driver, and/or other circuit components), lenses, and support/housing structures. The LED lamp may be used in many different kinds of fixtures, each having different heat dissipation rates. For example, a recessed-ceiling fixture may be extensively insulated and therefore have a high ambient temperature. Designers of LED lamps cannot predict the type of fixture with which the LED lamp will be used and therefore may include thermal protection mechanisms (also known as thermal-foldback circuits) to monitor the temperature of the lamp and automatically reduce the LED drive current when the temperature becomes too high. The reduction in drive current causes the LED lamp to draw less power and generate less heat, thereby preventing the bulb from overheating and prolonging the lifespan of the LEDs therein.

There is, however, a drawback to this approach. Dimmers have minimum hold current requirements, as do the electronic low-voltage transformers commonly used in lighting systems, in order to function properly. The thermal-foldback circuits described above, when engaged, cause an LED lamp to draw less current. If the current drawn by the LED lamp drops too far, it may fall below the hold current required by the dimmer and/or electronic transformer. At that point, the dimmer and/or electronic transformer may no longer function properly, causing flickering of the lamp due to intermittent delivery of power from those upstream components.

SUMMARY

In general, various aspects of the systems and methods described herein relate to thermal foldback circuits that "chop" a portion of the waveform pulled from a dimmer and/or transformer (i.e., cause a portion of the waveform to be substantially equal to zero while leaving the rest unaffected) when a detected temperature of the LED crosses a threshold. During the unchopped portion of the waveform, the current drawn from the dimmer/transformer is substantially the same as it was before the chopping. The chopping occurs in each cycle of the pulled waveform, and the amount of chopping varies with the amount of power (and therefore temperature) reduction required to cool the LED. Thus, the minimum hold time of any upstream components (e.g., dimmer or transformer) is met during the unchopped portion of the waveform, while the upstream components are off during the chopped portion.

In one aspect, a method protects an LED lamp from overheating. An over-temperature condition is detected in an LED lamp component. A portion of a waveform drawn by the LED lamp from a power supply is chopped to substantially zero in response to the over-temperature condition to thereby reduce power consumed by the LED lamp. An unchopped portion of the waveform draws a current greater than a hold current of a component supplying the waveform to the LED lamp.

In various embodiments, the component supplying the waveform is an electronic transformer or a dimmer. A first part of the unchopped waveform may be applied to a non-light-emitting load and a second part of the unchopped waveform to the LED. The second part of the unchopped waveform may be applied to the LED at substantially the same time each cycle resulting in substantially the same amount of power being delivered to the LED each cycle. The method may include detecting when power delivery to the non-light-emitting load has stabilized. The second part of the unchopped waveform may be applied to the LED upon detection of stabilized power delivery to the non-light-emitting load. An LED driver may be disabled during the chopped portion of the waveform, thereby reducing power consumption of the LED lamp. The LED driver may be re-enabling prior to a next unchopped portion of the waveform to thereby bleed charge stored on the component supplying the waveform. The re-enabling may occur before a last firing of a diac in the component supplying the waveform. A change in a trailing or leading edge of the unchopped portion of the waveform (due to a change in a dimmer) may be detected; a timing of the re-enabling of the LED driver may be adjusted in response to the detected waveform change.

In another aspect, a system protects an LED in an LED lamp from overheating. A thermal sensor detects a temperature of an LED lamp component. An LED driver circuit chops a portion of an input power waveform drawn by the LED lamp from a power supply in response to the detected temperature increasing past a threshold.

In various embodiments, a non-light-emitting load (including, e.g., a zener diode) receives a first part of an unchopped portion of the waveform each cycle. A load selector may switch application of the waveform between the LED and a non-light-emitting load. A bleed controller may re-enable the LED driver circuit during a chopped portion of the waveform to bleed charge from a component supplying the waveform; the bleed controller may be configured to detect an effect of a dimmer circuit and adjusting a timing of the re-enabling of the LED driver circuit based thereon.

In yet another aspect, a driver circuit converts a chopped signal waveform supplied by a system component into a power signal suitable for driving an LED. LED driver circuitry receives the chopped waveform and powering the LED based thereon. A bleed controller re-enables the LED driver circuit during an a chopped portion of the waveform to bleed charge from the system component. In various embodiments, the system component is a dimmer circuit and the bleed controller is configured to detect an effect of the dimmer circuit and to adjust a timing of the re-enabling of the LED driver circuit based thereon.

In still another aspect, a system protects an LED in an LED lamp from overheating. A thermal sensor detects a temperature of an LED lamp component. An LED driver circuit chops a portion of an input power waveform coming from a power supply powering the LED lamp in response to the detected temperature increasing past a threshold. The input power waveform is chopped to reduce overall average input power to the LED lamp while maintaining a required minimum input power level for a component supplying the waveform during unchopped portions of the input power waveform These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. In the following description, various embodiments of the present invention are described with reference to the following drawings, in which.

DETAILED DESCRIPTION

Described herein are various embodiments of methods and systems for protecting an LED lamp from overheating while preventing flickering in the lamp due to violation of a hold-current requirement of an upstream component (e.g., a dimmer or an electronic transformer). In various embodiments, the thermal foldback system monitors the temperature of an LED in the LED lamp. If the temperature increases past a threshold (i.e., exhibits an over-temperature condition), the thermal foldback system chops the input power waveform (i.e., voltage or current) pulled from an upstream component (e.g., a transformer and/or dimmer) until the over-temperature condition is resolved. The amount of chopping may be proportionate to the amount the temperature exceeds the threshold. In various embodiments, a non-light-emitting load may be used to stabilize the drive current before it is applied to the LED, and an LED drive circuit may be pre-engaged to bleed off charge stored in the upstream electronic transformer.

Figure 1:
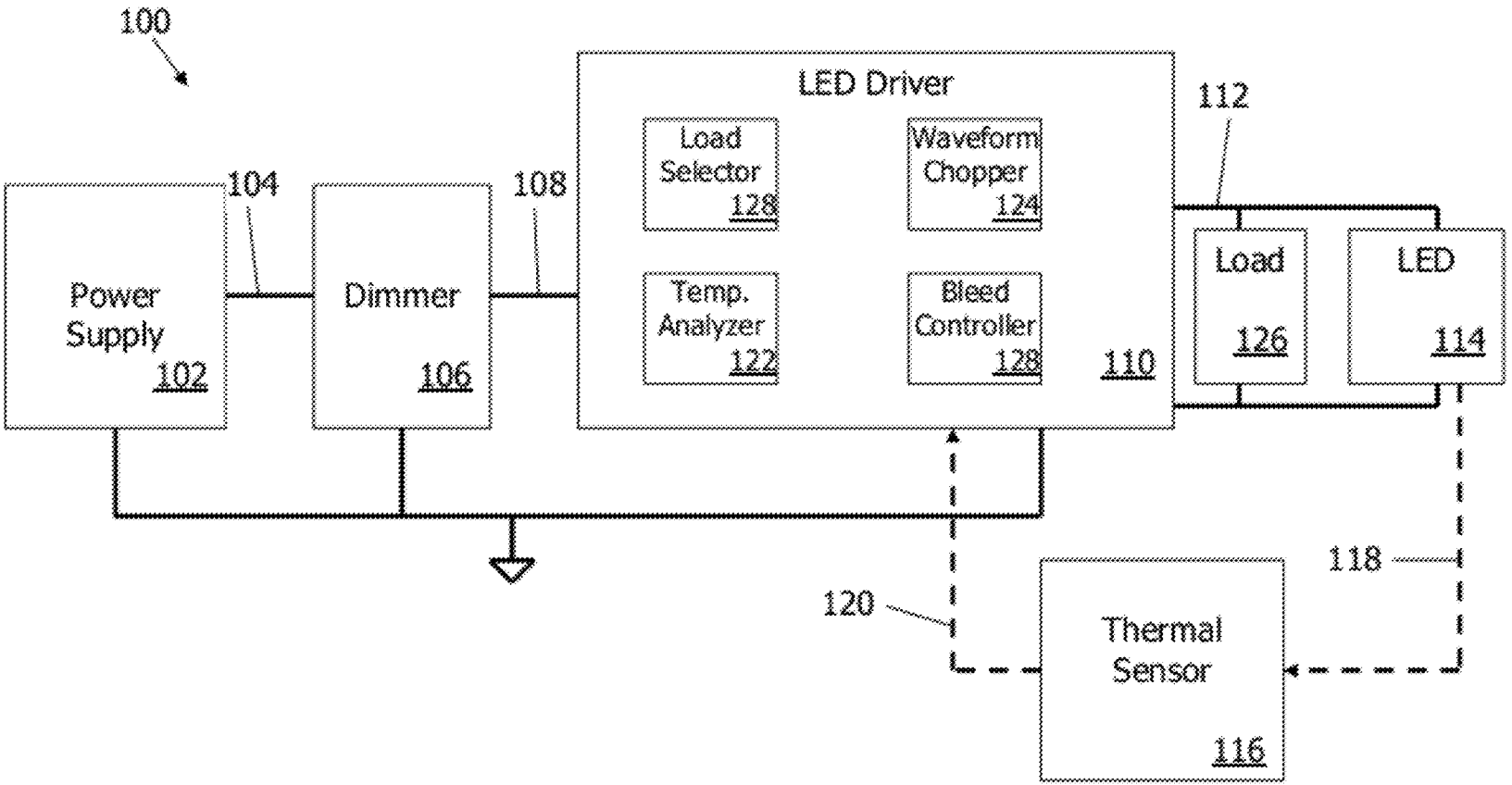
FIG. 1 is a block diagram illustrating an LED driver circuit for protecting an LED from an over-temperature condition in accordance with an embodiment of the invention.

One embodiment of such a thermal foldback system 100 is illustrated in FIG. 1. A power supply 102, such as an AC mains supply or other AC supply, provides power to the system via a power bus 104. The power supply 102 may include or consist of an electronic transformer. A dimmer circuit 106 may be included to dim the signal coming over the power bus 104, thereby producing a dimmed signal 108. The dimmer 106 may be a leading-edge dimmer, trailing-edge dimmer, or any other type of dimmer circuit.

An LED driver circuit 110 receives the dimmed signal 108 (or, in an embodiment in which there is no dimmer 106, the power signal 104). The LED driver circuit 110, among other functions described in more detail below, translates the incoming voltage-mode signal 108/104 into a current-mode signal 112 suitable for driving an LED 114, which typically requires a constant-current input.

The LED 114 may include one or more LEDs arranged in one or more strings. The LED 114 may further include other circuitry, such as current sensors or series resistors; the current invention is not limited to any particular type of LED or support circuit used therewith. A capacitor may be placed in parallel with the LED 114 to smooth out the power signal applied to the LED 114.

A thermal sensor 116 monitors a temperature of the LED 114 via a sensor signal 118 and converts the sensed temperature in a corresponding voltage or current signal 120. The thermal sensor may be housed within the LED 114, disposed in a separate housing, or housed within the LED driver circuit 110. Any thermal-sensing component or circuit known in the art is within the scope of the present invention. In various embodiments, the thermal sensor 116 is a thermistor, a thermocouple, or an integrated-circuit sensor.

The LED driver 110 may include a temperature analyzer 122 for receiving the sensed temperature signal 120 and determining if an over-temperature condition exists. The temperature analyzer 122 may compare the sensed temperature 120 to a threshold and generate an appropriate response if the sensed temperature 120 is greater than the threshold. In one embodiment, the response changes to indicate how far over the threshold the sensed temperature 120 is; in another embodiment, the response is a binary response (i.e., greater or not greater than the threshold). The threshold may be fixed at an average safe value (e.g., 100, 150, or 200 degrees Fahrenheit) or may be adjusted based on a detected type of the LED lamp 114. An LED lamp 114 having an LED more susceptible to temperature damage, for example, may be assigned a lower threshold than an LED having more temperature resistance.

A waveform chopper 124 receives the output of the temperature analyzer 122 and chops an input power waveform pulled from the power supply 102 and/or dimmer 106 via the input bus 104/108 into a chopped portion and an unchopped portion accordingly. If the temperature analyzer 122 indicates that the over-temperature condition is more severe, the waveform chopper 124 may chop a greater portion of the waveform. The operation of the waveform chopper 124 is described in greater detail with reference to FIGS. 2-4.

Figure 2:
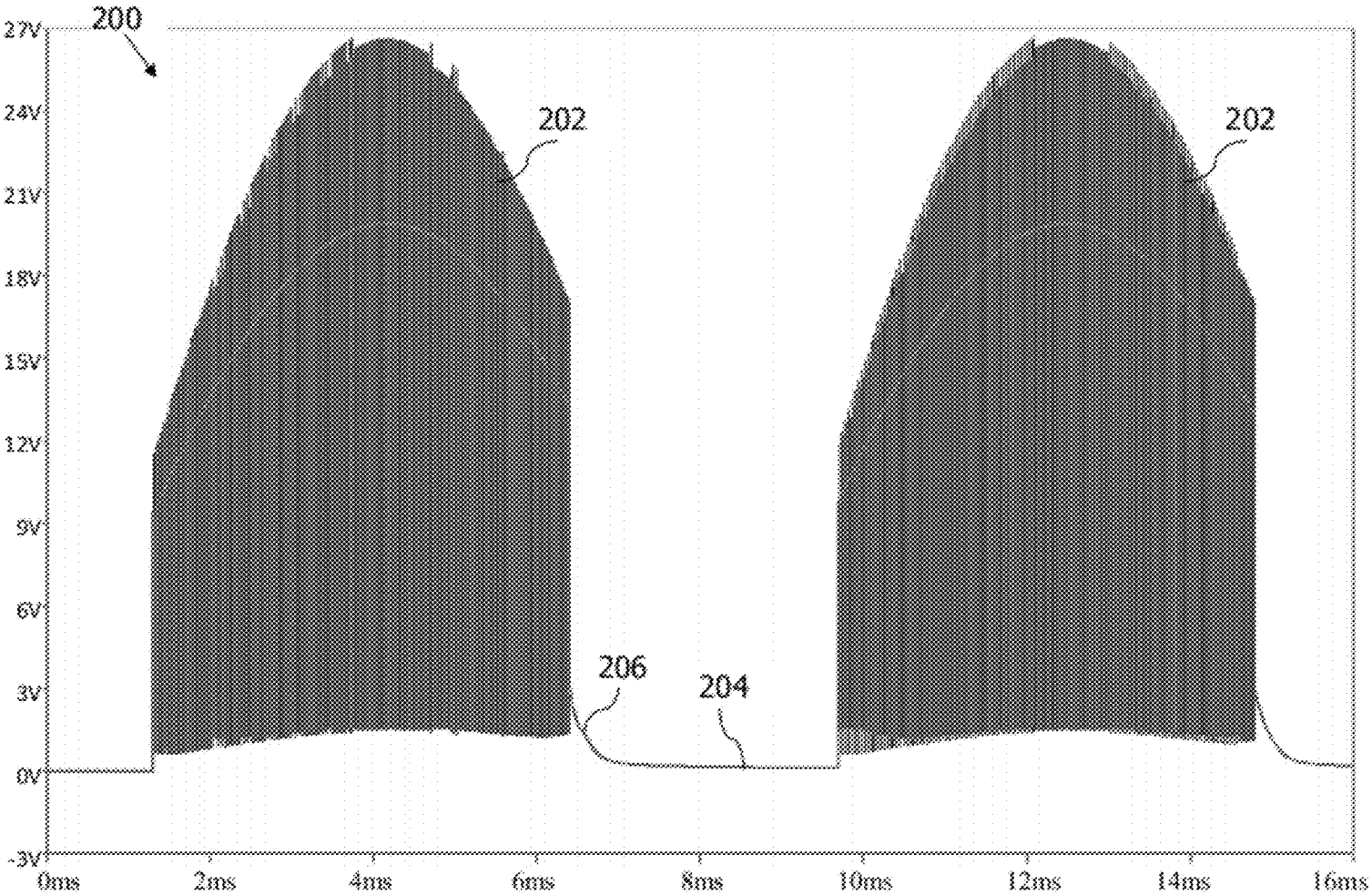
FIGS. 2-4 are graphs of an unchopped, moderately chopped, and severely chopped input power waveform, respectively, in accordance with embodiments of the invention.

An input waveform 200, such as the waveform received from the power supply 102 or the dimmer 106, is illustrated in FIG. 2. The depicted voltage waveform includes a nonzero portion 202 and a substantially zero portion 204. The nonzero portion 202 includes the modulated power envelope generated by an electronic transformer, wherein a high-frequency signal has a varying amplitude such that its envelope approximates a rectified 60 Hz AC mains supply voltage. If a dimmer 106 is not present or is unengaged, no substantially zero portion 204 may exist. As the dimmer 106 adjusts the signal 104 from the power supply 102, however, the substantially zero portion 204 may grow or shrink.

The substantially zero portion 204 may be equal to zero or may be near zero. In various embodiments, the substantially zero portion 204 is no more than 10%, 5%, 2%, or 1% of a voltage in the nonzero portion 202. There may be, however, a transient portion 206 within the substantially zero portion 204 in which the voltage nears zero but is higher than in the rest of the portion 204. No voltage in the substantially zero portion 204, however, may be great enough to drive the LED driver 110 and cause the LED 114 to turn on or emit perceptible light.

Figure 3:
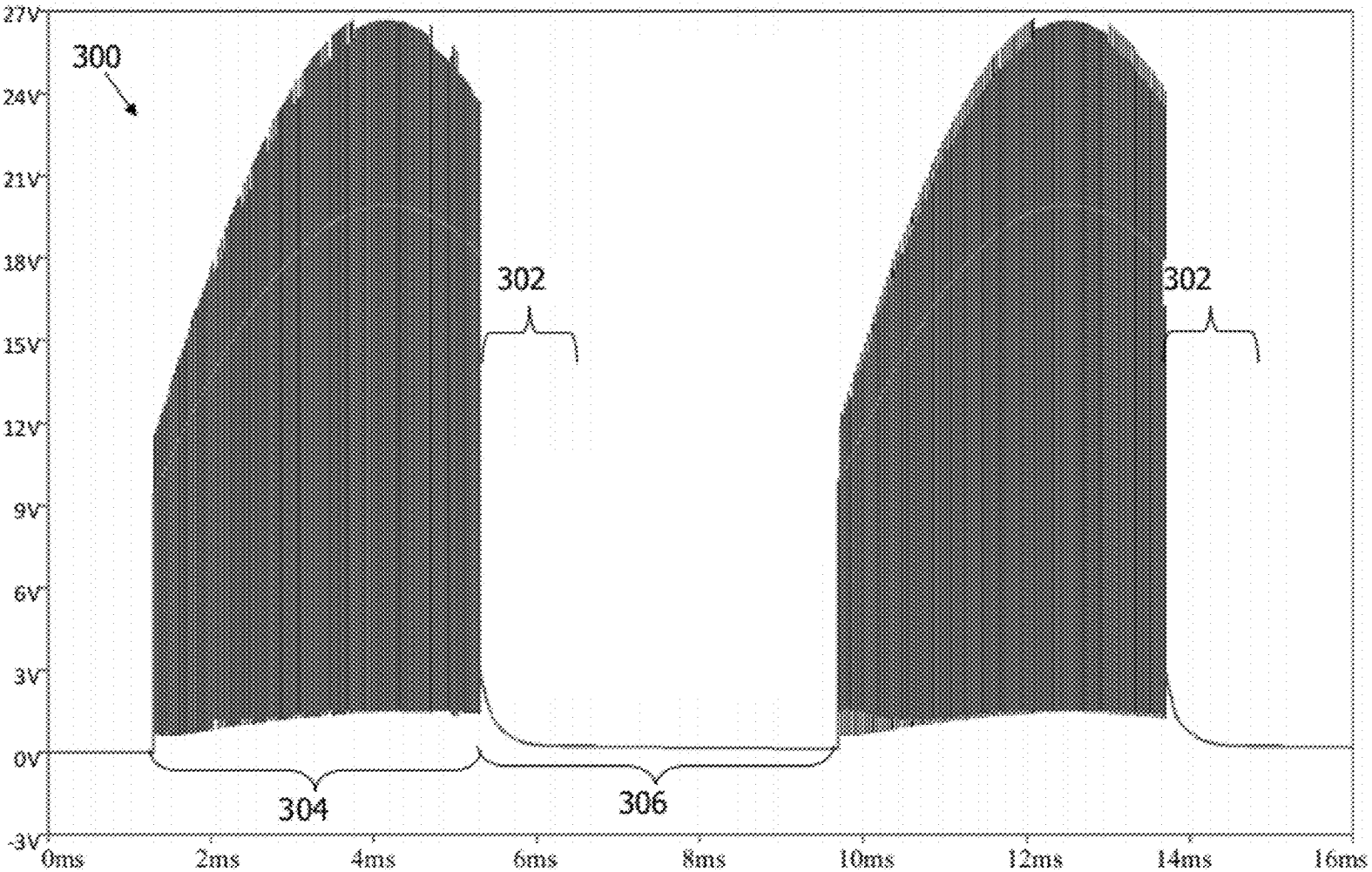

The effect of chopping a portion of the nonzero portion 202 of the input power signal 200 is shown in FIG. 3. Here, an additional portion 302 of the nonzero portion 202 of the waveform 300 has been chopped by the waveform chopper 124 in response to an over-temperature condition reported by the temperature analyzer 122. The waveform chopper 124 may chop the waveform 300 using any means or technique known in the art, such as, for example, by selectively enabling and disabling an output MOSFET switch. As used herein, the term unchopped portion refers to the nonzero portions 304 of the waveform 300, and the term chopped portion refers to the substantially zero portions 306 of the waveform 300, whether the zeroing of the waveform 300 was initiated by the waveform chopper 124 or by the dimmer 106.

Figure 4:
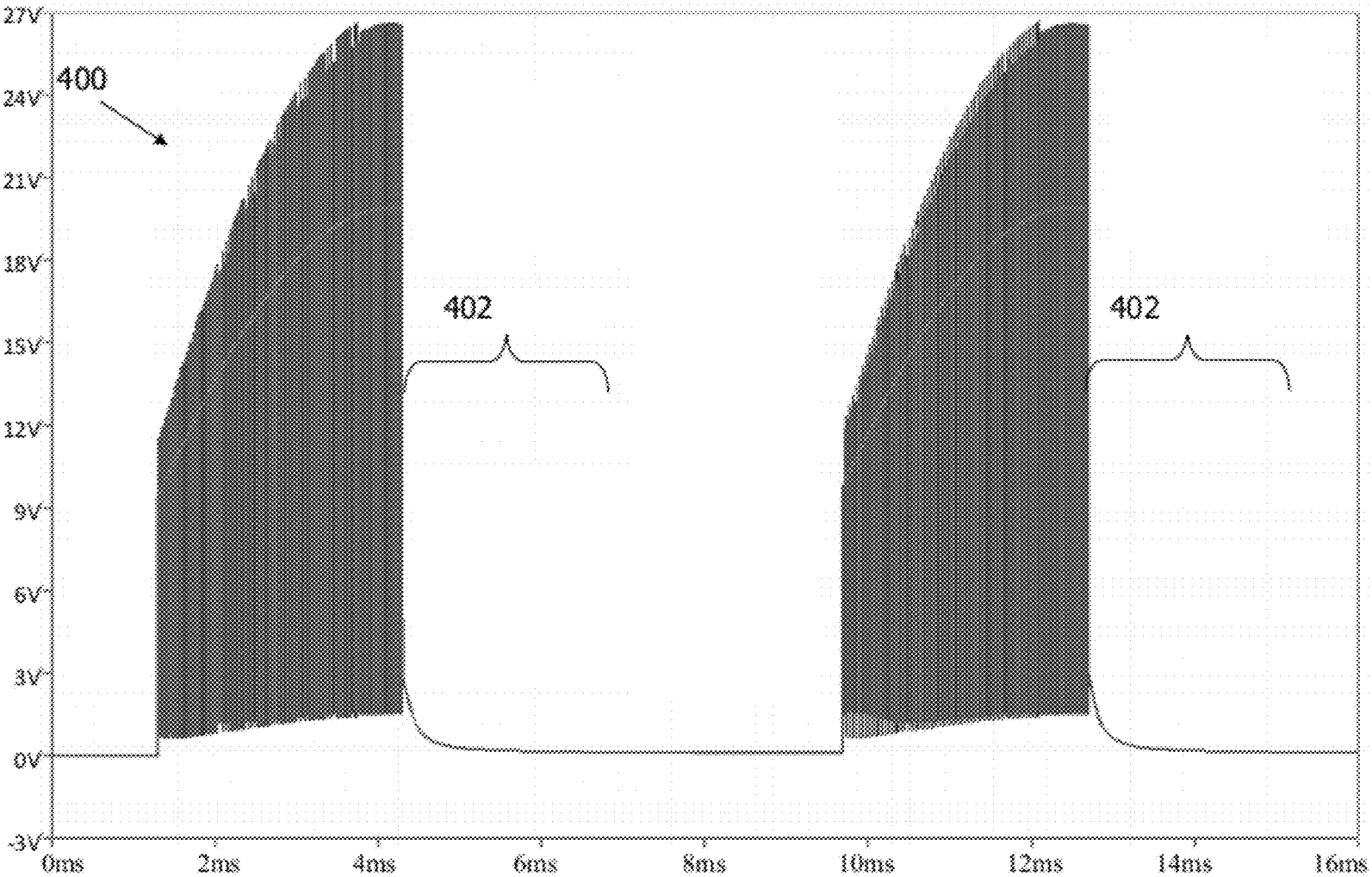

A more extreme example of chopping is illustrated in FIG. 4. There, a waveform 400 has had even greater portions 402 removed from the nonzero portions 202 of the original waveform 200, as illustrated in FIG. 2. This greater amount of chopping may be executed in response to a greater over-temperature condition that that which necessitated the chopping depicted in FIG. 3. In other words, the temperature of the LED 114 was greater with reference to the resultant waveform 400 of FIG. 4 than the waveform 300 of FIG. 3. It will be appreciated that, in both FIGS. 3 and 4, the magnitude of the voltage of the unchopped portion is substantially the same as the corresponding portions of the original waveform depicted in FIG. 2. Thus, the current drawn by the LED driver 110 during the unchopped portions of each of the three waveforms 200, 300, 400 is substantially the same, despite the different amounts of chopping to the rest of the waveforms. In each of the unchopped portions, any upstream components that depend on a minimum hold current (such as the power supply 102 and/or the dimmer 106) have that hold current met during the unchopped portions and therefore do not cause flickering or other undesirable behavior in the LED 114.

Referring again to FIG. 1, in one embodiment, a non-light-emitting load 126, disposed in parallel with the LED 114 at the output 112 of the LED driver 110, is used to stabilize the output signal 112 before it is applied to the LED 114. A load selector 128 may be used to send a short burst of power at the beginning of each cycle to the non-light-emitting load 126 before power is sent to the LED 114. The short burst may have a duration of approximately 1%, 5%, or 10% of the time power is sent to the LED 114. The load selector 128 may transition power delivery from the non-light-emitting load 126 to the LED 114 at substantially the same time each cycle (e.g., the transition time may vary by no more than 1%, 2%, or 5% cycle-to-cycle). Thus, power may be applied to the LED at substantially the same time each cycle, resulting in substantially the same amount of power (e.g., within 1%, 2%, or 5% of average power) being delivered to the LED each cycle.

Sending power to the non-light-emitting load 126 at the beginning of the cycle charges or otherwise stabilizes capacitors and/or other stored-charged elements in the power supply 102 and/or dimmer 106 before turning off the non-light-emitting load 126 and turning on the LED 114. Once power is stabilized and sent to the LED 114, it has fewer deleterious time-varying effects, thereby preventing flickering or other visible variations in the LED 114. This type of power stabilization may be especially effective at lower dimmer settings because the power-delivery envelopes are short at those settings. Even slight variations in the charging curves of the capacitors cycle by cycle may cause visible effects in the light output of the LED 114.

In one embodiment, the non-light-emitting load is a non-linear load such as a zener diode having a voltage close to the voltage of the LED 114. A low-ohm resistor may be placed in series with the zener diode. The zener diode and resistor allow the capacitors at the output of the power supply 102 and/or dimmer 106 to quickly charge to roughly the voltage of the LED 114; the zener diode then holds the voltage there when it conducting in accordance with its non-linear conduction curve.

In another embodiment, some or all portions of the LED driver 110 are shut off or otherwise put in a low-power state during the chopped portion of the input waveform 104/108. For example, the output power drivers responsible for supplying power to the LED 114 may be powered down to reduce the overall power consumption of the LED driver 110. While the LED driver 110 is powered down, however, it does not draw current from the electronic transformer in the power supply 102. During this time, the electronic transformer has likely stalled, and a startup circuit therein (e.g., a diac) is likely trying to re-start the transformer. In this situation, any capacitors inside the electronic transformer remain wholly or partially charged. Unless these capacitors are discharged (or "bled") by the end of the cycle, the electronic transformer may start up too early in the next cycle, resulting in severe flickering of the LED 114.

In one embodiment, a bleed controller 128 monitors when the tail (i.e., the trailing edge) of the power envelope delivered by the power supply 102 occurs during each cycle. The bleed controller 128 may also detect when and if the startup circuit attempts to re-start the electronic transformer. The bleed controller 128 may therefore re-activate the LED driver 110 (i.e., wake it from its power-saving or off state) after the tail of the power envelope passes but just before the last time that the startup circuit fires. Doing so enables the electronic transformer to start oscillating enough to bleed down any capacitors or other charge-storage elements therein before the next cycle starts.

Figure 5:
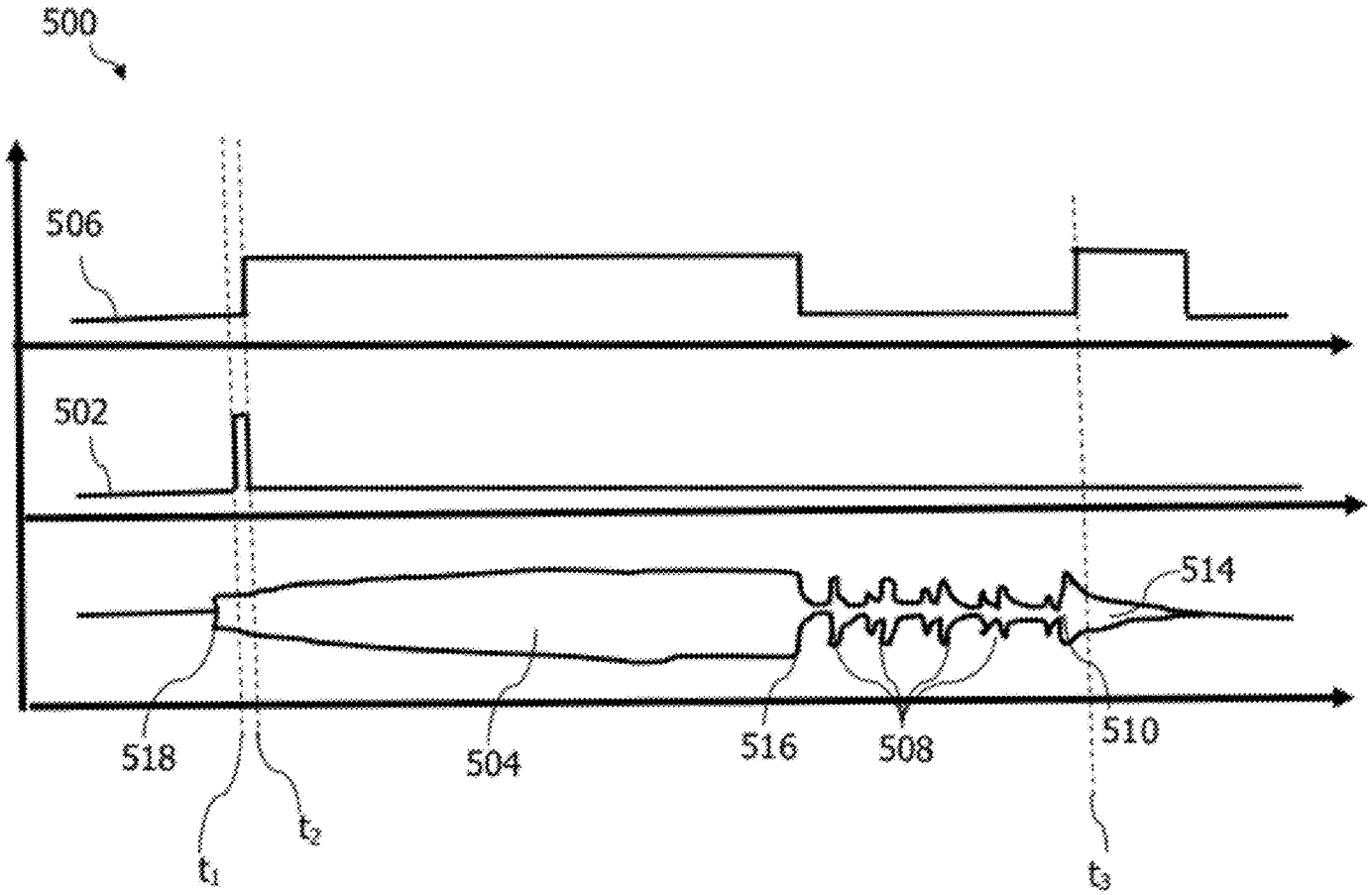
FIG. 5 is a graph of a transformer output and control signals in accordance with an embodiment of the invention.

An example of the relationship between the various signals described above is depicted as a series of curves 500 in FIG. 5. A first control signal 502 activates at at time $t_1$ corresponding to at time at or near the beginning 518 of the power envelope 504 output by the power supply 102 (see FIG. 1). The first control signal 502 is used to enable the non-light-emitting load 126 to stabilize the power signal 504 before it is applied to the LED 114. Once the power signal 504 has been stabilized, the first control signal 502 shuts off at a time $t_2$. A second control signal 506 activates at or near the same time $t_2$ to apply the power envelope 504 to the LED 114, once the signal has been stabilized, for the remainder of the power envelope 504.

The diac within the electronic transformer fires when the LED driver 110 has been turned off, as shown by the power spikes 508. Just before the last time the diac fires as indicated at 510, the first control signal 506 is asserted again at a time $t_3$ to re-enable the LED driver 110 so that any capacitors in the electronic transformer can bleed down during the tail 514.

In one embodiment, the dimmer 106 is a trailing-edge dimmer and therefore alters the timing of the trailing edge 516 of the power envelope 504. In this embodiment, the bleed controller 128 includes conventional programming (e.g., a software module) for tracking the trailing edge 516. For example, the controller 128 may be programmed to may detect a difference between changes in the trailing edge 516 due to jitter or other noise and the dimmer 106. Based on the detected difference, the second assertion 512 of the first control signal may come sooner or later in time. The bleed controller 128 may be programmed to further track the time of the first rising edge 518 in order to account for variations therein due to, for example, noise in the transformer and/or action of a dimmer. The tracked time of the first rising edge 518 may then be used to adjust the times $t_1$, $t_2$ of the assertion of the control signals 502, 506.

Figure 6:
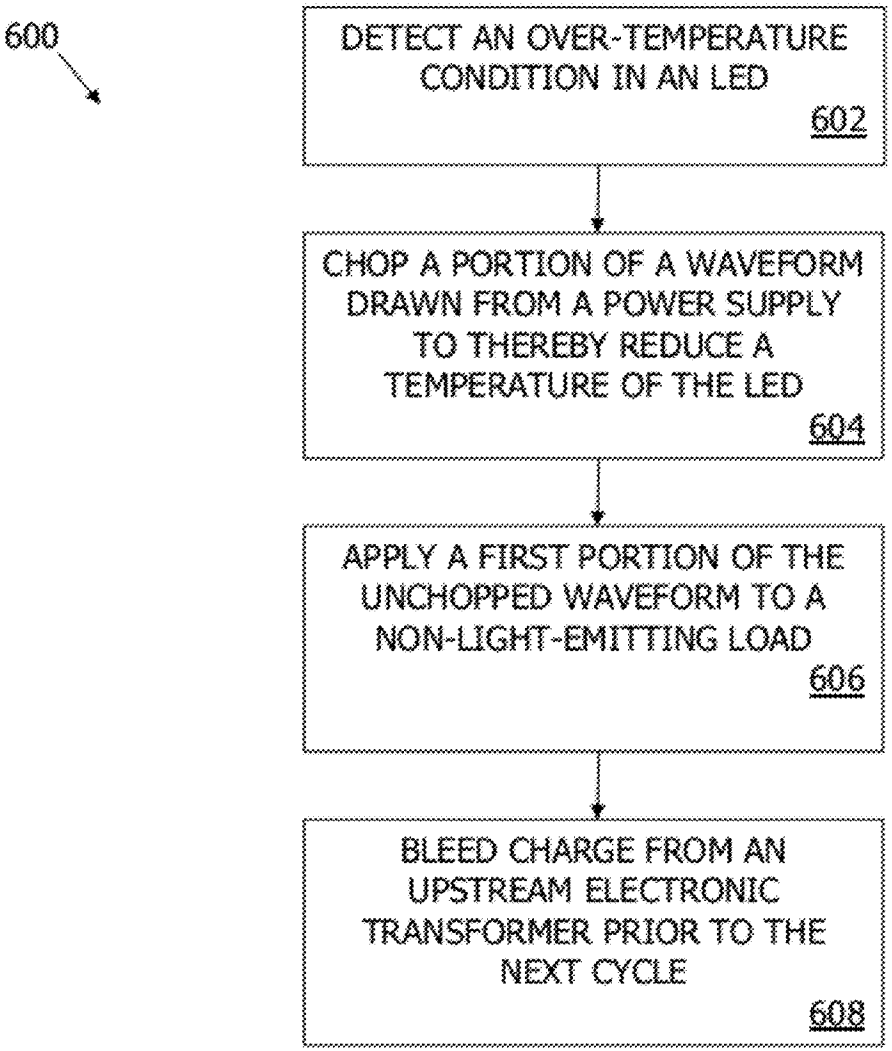
FIG. 6 is a flowchart illustrating a method for protecting an LED from an over-temperature condition in accordance with an embodiment of the invention.

A method 600 for protecting the LED 114 from overheating, in accordance with an embodiment of the invention, is illustrated in FIG. 6. An over-temperature condition is detected in the LED 114 (Step 602), and a portion of the input power waveform drawn from a power supply and supplied to the LED 114 is chopped (Step 604). Chopping off the input power waveform reduces the total power delivered to the LED and therefore also reduces the temperature of the LED. In one embodiment, a first portion of the waveform is applied to a non-light-emitting load 126 (Step 606) to stabilize the power before it is applied to the LED 114. In another embodiment, charge is bled from an upstream electronic transformer, prior to the beginning of the next cycle, by re-enabling a disabled LED driver 110 (Step 608).

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. A method for protecting an LED lamp from overheating, the method comprising:

detecting an over-temperature condition in an LED lamp component; and chopping to substantially zero a portion of a waveform drawn by the LED lamp from a power supply, in response to the over-temperature condition, to thereby reduce power consumed by the LED lamp, wherein an unchopped portion of the waveform draws a current greater than a hold current of a component supplying the waveform to the LED lamp.

2. The method of claim 1, wherein the component supplying the waveform is an electronic transformer or a dimmer.

3. The method of claim 1, further comprising applying a first part of the unchopped waveform to a non-light-emitting load and applying a second part of the unchopped waveform to the LED.

4. The method of claim 3, wherein the second part of the unchopped waveform is applied to the LED at substantially the same time each cycle resulting in substantially the same amount of power being delivered to the LED each cycle.

5. The method of claim 3, further comprising detecting when power delivery to the non-light-emitting load has stabilized.

6. The method of claim 5, wherein the second part of the unchopped waveform is applied to the LED upon detection of stabilized power delivery to the non-light-emitting load.

7. The method of claim 1, further comprising disabling an LED driver during the chopped portion of the waveform, thereby reducing power consumption of the LED lamp.

8. The method of claim 7, further comprising re-enabling the LED driver prior to a next unchopped portion of the waveform to thereby bleed charge stored on the component supplying the waveform.

9. The method of claim 8, wherein the re-enabling of the LED driver occurs before a last firing of a diac in the component supplying the waveform.

10. The method of claim 8, further comprising detecting a change in a trailing or leading edge of the unchopped portion of the waveform due to a change in a dimmer, wherein a timing of the re-enabling of the LED driver is adjusted in response to the detected waveform change.

11. A system for protecting an LED in an LED lamp from overheating, the system comprising:

a thermal sensor for detecting a temperature of an LED lamp component; and an LED driver circuit for chopping a portion of an input power waveform drawn by the LED lamp from a power supply in response to the detected temperature increasing past a threshold.

12. The system of claim 11, further comprising a non-light-emitting load for receiving a first part of an unchopped portion of the waveform each cycle.

13. The system of claim 12, wherein the non-light-emitting load comprises a zener diode.

14. The system of claim 11, wherein the LED driver circuit comprises a load selector for switching application of the waveform between the LED and a non-light-emitting load.

15. The system of claim 11, wherein the LED driver circuit comprises a bleed controller for re-enabling the LED driver circuit during a chopped portion of the waveform to bleed charge from a component supplying the waveform.

16. The system of claim 15, wherein the bleed controller is configured to detect an effect of a dimmer circuit and adjusting a timing of the re-enabling of the LED driver circuit based thereon.

17. A driver circuit for converting a chopped signal waveform supplied by a system component into a power signal suitable for driving an LED, the circuit comprising:

LED driver circuitry for receiving the chopped waveform and powering the LED based thereon; and a bleed controller for re-enabling the LED driver circuit during an a chopped portion of the waveform to bleed charge from the system component.

18. The system of claim 17, wherein the system component is a dimmer circuit and the bleed controller is configured to detect an effect of the dimmer circuit and to adjust a timing of the re-enabling of the LED driver circuit based thereon.

19. A system for protecting an LED in an LED lamp from overheating, the system comprising:

a thermal sensor for detecting a temperature of an LED lamp component; and an LED driver circuit for chopping a portion of an input power waveform coming from a power supply powering the LED lamp in response to the detected temperature increasing past a threshold, wherein the input power waveform is chopped to reduce overall average input power to the LED lamp while maintaining a required minimum input power level for a component supplying the waveform during unchopped portions of the input power waveform.

* * * * *